US007515520B2

(12) United States Patent
Kotaka et al.

(10) Patent No.: US 7,515,520 B2
(45) Date of Patent: Apr. 7, 2009

(54) RECORDING APPARATUS AND LIQUID EJECTING APPARATUS

(75) Inventors: Toshikazu Kotaka, Shiojiri (JP); Naohiro Ueyama, Matsumoto (JP); Yasuo Motohashi, Suginami (JP); Satoru Watanabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/840,699

(22) Filed: Aug. 17, 2007

(65) Prior Publication Data

US 2008/0043580 A1 Feb. 21, 2008

(30) Foreign Application Priority Data

Aug. 18, 2006 (JP) ..... 2006-223358

(51) Int. Cl.
*G11B 7/00* (2006.01)

(52) U.S. Cl. ..... 369/100; 369/132; 385/12; 385/147

(58) Field of Classification Search ..... 385/147; 369/100, 132
See application file for complete search history.

(56) References Cited

U.S. PATENT DOCUMENTS 6,007,194 A * 12/1999 Yokoyama et al. ..... 347/104
6,505,827 B2 * 1/2003 Kawakami et al. ..... 271/169

FOREIGN PATENT DOCUMENTS

| | | |
|---|---|---|
| JP | 08-259037 | 10/1996 |
| JP | 08-310068 | 11/1996 |
| JP | 11-011426 | 1/1999 |
| JP | 2002-332128 | 11/2002 |

* cited by examiner

*Primary Examiner*—Jennifer Doan
(74) *Attorney, Agent, or Firm*—Workman Nydegger

(57) ABSTRACT

A recording apparatus including a recording unit that performs recording on a recording medium; a transporting unit capable of transporting the recording medium; a first guide member and a second guide member disposed facing the first guide member having an section of a transport path of the recording medium disposed therebetween; and an optical sensor including a light-emitting portion and a light-receiving portion and having an optical axis that traverses the transport path of the recording medium between the first and second guide members. At least one of the light-emitting portion and the light-receiving portion projects from an outer side of the transport path towards the first guide member. The first guide member has a cutout having an opening where the light-emitting portion or the light-receiving portion is disposed. The opening is covered with a sheet member except for an area where the optical axis of the optical sensor extends.

5 Claims, 11 Drawing Sheets

RECORDING APPARATUS AND LIQUID EJECTING APPARATUS

BACKGROUND

1. Technical Field

The present invention relates to a recording apparatus equipped with a recording unit that performs recording on a recording medium and a transporting unit that is disposed upstream of the recording unit and transports the recording medium downstream. The invention also relates to a liquid ejecting apparatus.

Here, a liquid ejecting apparatus is not limited to recording apparatuses such as printers, copiers, and facsimile apparatuses that employ an ink jet recording head to perform recording on a recording medium by emitting ink from the recording head. The term "liquid ejecting apparatus" used above is also directed to other apparatuses that allow liquid used for an intended purpose in place of ink to adhere to a liquid-receiving medium, corresponding to a recording medium, by ejecting the liquid from a liquid ejecting head, corresponding to an ink jet recording head, towards the liquid-receiving medium.

In addition to recording heads, known examples of liquid ejecting heads include color-material ejecting heads used for forming color filters in liquid-crystal displays, electrode-material (conductive paste) ejecting heads used for forming electrodes in organic electroluminescence displays and field emission displays, bioorganic-material ejecting heads used for manufacturing biochips, and sample ejecting heads serving as precision pipettes.

2. Related Art

One example of a recording apparatus or a liquid ejecting apparatus is a printer. In a printer, a sheet transport path is provided for transporting a sheet, which is an example of a recording medium or a liquid-receiving medium. At a predetermined position on the sheet transport path is provided a sheet detector that detects passing of the leading end or trailing end of a sheet. When the passing of the leading end or trailing end of a sheet is detected, the printer performs required sheet-feeding control. JP-A-8-259037 discloses an example of a sheet detector that is equipped with a lever member provided rotatably on a sheet transport path, and a detecting unit that detects the rotational shifting of the lever member. In place of the sheet detector of a contact type disclosed in JP-A-8-259037, an optical sensor of a non-contact type that is equipped with a light-emitting portion and a light-receiving portion may also be used.

When such a non-contact optical sensor is to be used as a sheet detector, it is preferable that, in view of detection accuracy, the light-emitting portion and the light-receiving portion be properly mounted at predetermined positions and that the light-emitting portion and the light-receiving portion be disposed as close to the sheet transport path as possible. On the other hand, in a case where the sheet transport path is to be formed between two guide members, these guide members become obstacles to the placement of the optical sensor. Therefore, if the sheet transport path is to be formed between two guide members, the guide members may be provided with window holes within which the light-emitting portion and the light-receiving portion included in the optical sensor may be disposed.

However, in an assembly process of the printer, if the two guide members are first installed to form the sheet transport path therebetween and the optical sensor is subsequently mounted thereto, the workability in the mounting process of the optical sensor and the workability in a positional adjustment process of the mounted optical sensor are reduced. In addition, in the above-described structure, the fixation position of the optical sensor is distant from the sheet transport path, which is problematic in that the accuracy in the mount position of the optical sensor is reduced.

SUMMARY

An advantage of some aspects of the invention is that, in a case where an optical sensor is used as a sheet detector, the workability in the mounting process of the optical sensor is enhanced and the accuracy in the mount position of the optical sensor is improved.

A first aspect of the invention provides a recording apparatus that includes a recording unit that performs recording on a recording medium; a transporting unit that is disposed upstream of the recording unit and transports the recording medium downstream; a first guide member and a second guide member disposed facing the first guide member, the first and second guide members having an upstream section of a transport path of the recording medium disposed therebetween; and an optical sensor including a light-emitting portion and a light-receiving portion, the optical sensor having an optical axis that traverses the transport path of the recording medium between the first and second guide members. At least one of the light-emitting portion and the light-receiving portion projects from an outer side of the transport path towards the first guide member. The first guide member has a cutout having an opening that faces the second guide member. The cutout has the light-emitting portion or the light-receiving portion disposed therein. The opening of the cutout is covered with a sheet member except for an area where the optical axis of the optical sensor extends.

According to the first aspect, one of the light-emitting portion and the light-receiving portion constituting the optical sensor that detects passing of the recording medium projects from an outer side of the recording-medium transport path towards the first guide member at a position near a transport reference position of the recording medium. The first guide member has a cutout at least having an opening at the side near the transport reference position of the recording medium and at a side facing the second guide member. The light-emitting portion or the light-receiving portion is disposed within the cutout. Accordingly, when carrying out the assembly process of the recording apparatus, a mounting process of the optical sensor is preliminarily performed, and an attaching process of the first guide member is performed afterwards. In other words, the first guide member is in still its unattached state when the mounting process of the optical sensor is being performed. This enhances the workability in the mounting process of the optical sensor as well as facilitating the adjustment process of the mount position. In addition, the optical sensor can be fixed to a position near the recording-medium transport path, thereby preventing the accuracy in the mount position of the optical sensor from being reduced. Furthermore, the opening of the cutout is covered with a sheet member except for an area where the optical axis of the optical sensor extends. Therefore, when the recording medium passes the opening, the leading end of the recording medium is prevented from getting stuck at the opening. Consequently, this prevents bending of the leading end of the recording medium and also prevents the recording medium from being skewed as a result of the leading end thereof being stuck at the opening.

In the recording apparatus of the first aspect, the sheet member preferably has flexibility and is provided in the first guide member such that the sheet member is wound around the first guide member to cover the opening facing the second guide member.

Accordingly, since the sheet member may have flexibility and be provided in the first guide member such that the sheet member is wound around the first guide member to cover the opening facing the second guide member, the sheet member can be simplified in structure and can be provided at low cost. When the first guide member is to be attached to the recording apparatus so that the optical sensor is accommodated within the cutout, even if the optical sensor comes into contact with the sheet member, the optical sensor is prevented from being damaged since the sheet member is flexible.

In the recording apparatus of the first aspect, the light-emitting portion and the light-receiving portion are preferably integrated with each other, and the optical sensor is preferably mounted on the second guide member.

Accordingly, since the light-emitting portion and the light-receiving portion may be integrated with each other and the optical sensor may be mounted on the second guide member, the optical sensor can be preliminarily mounted on the second guide member, and the second guide member with the optical sensor mounted thereon can be subsequently attached to the base body of the recording apparatus. Consequently, this facilitates the mounting process of the optical sensor. In addition, because the optical sensor is directly mounted on the second guide member, which is one of components that form the recording-medium transport path, the accuracy in the mount position of the optical sensor can be improved.

In the recording apparatus of the first aspect, the transporting unit preferably includes a rotatably-driven transport driving roller and a transport driven roller rotated by being in contact with the transport driving roller. Moreover, it is preferable that the first guide member rotatably supports the transport driven roller and is pivotably attached to a main frame constituting a base body of the recording apparatus.

Accordingly, since the first guide member may rotatably support the transport driven roller and be pivotably attached to the main frame constituting the base body of the recording apparatus, the components such as the first guide member and the transport driven roller can be preliminarily assembled together into a unit. Thus, the assembled unit can be simply attached to the base body of the recording apparatus, thereby achieving improved assembly workability.

A second aspect of the invention provides a liquid ejecting apparatus that includes a liquid ejecting unit that ejects liquid onto a liquid-receiving medium; a transporting unit that is disposed upstream of the liquid ejecting unit and transports the liquid-receiving medium downstream; a first guide member and a second guide member disposed facing the first guide member, the first and second guide members having an upstream section of a transport path of the liquid-receiving medium disposed therebetween; and an optical sensor including a light-emitting portion and a light-receiving portion, the optical sensor having an optical axis that traverses the transport path of the liquid-receiving medium between the first and second guide members. At least one of the light-emitting portion and the light-receiving portion projects from an outer side of the transport path towards the first guide member. The first guide member has a cutout having an opening that faces the second guide member. The cutout has the light-emitting portion or the light-receiving portion disposed therein. The opening of the cutout is covered with a sheet member except for an area where the optical axis of the optical sensor extends.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
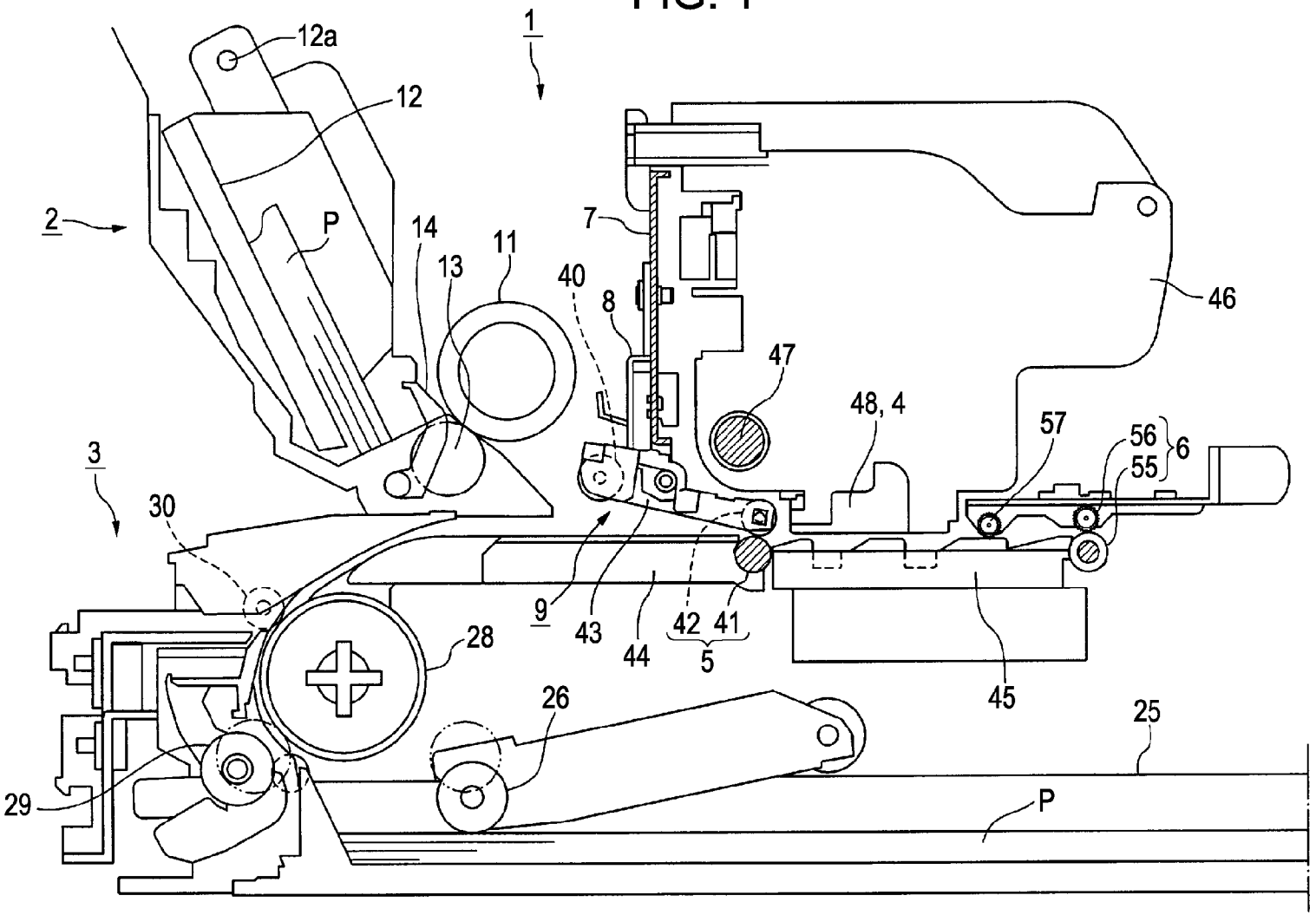
FIG. 1 is a schematic cross-sectional view of a printer according to the invention.
Figure 2:
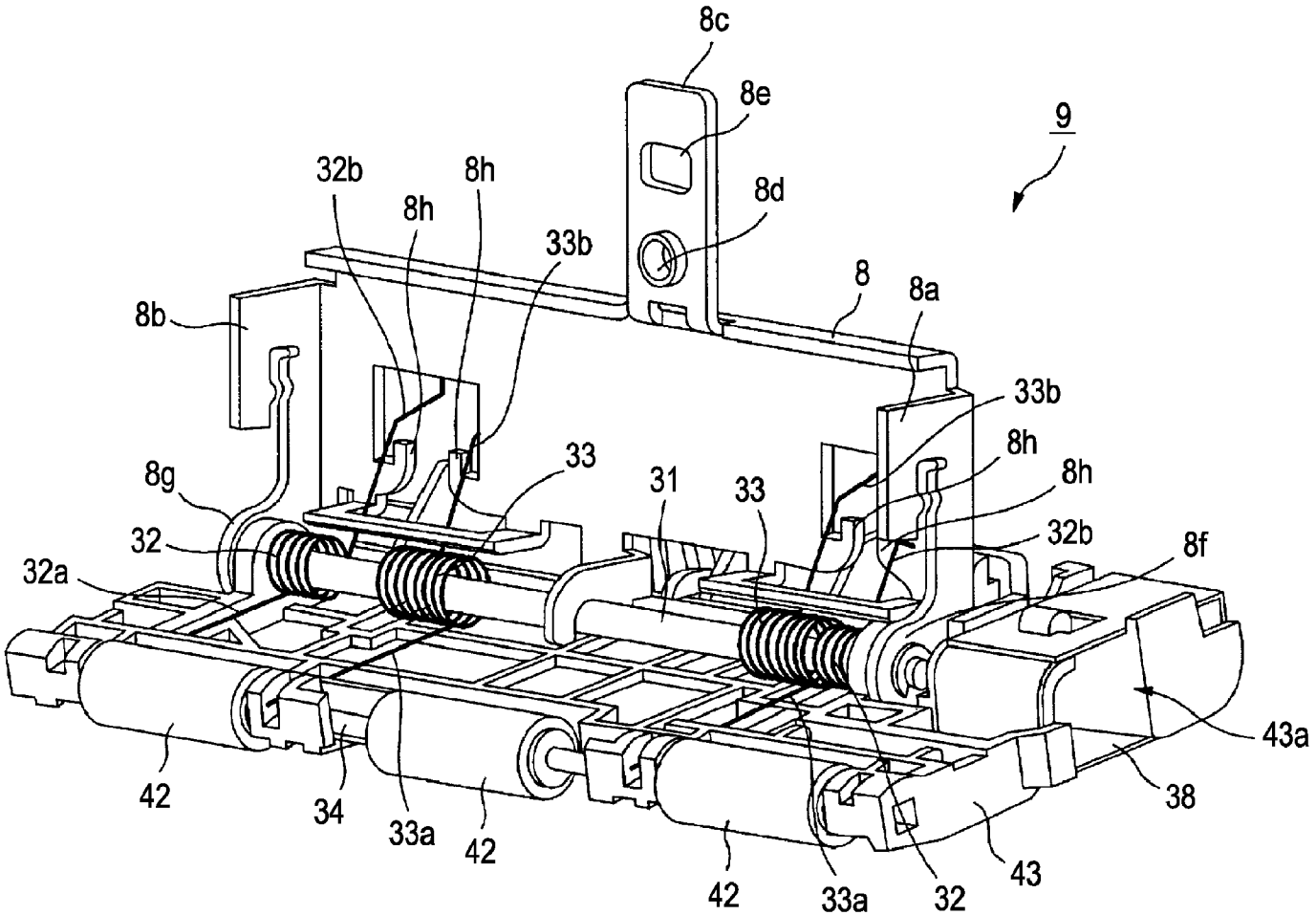
FIG. 2 is a perspective view of an upper sheet-guiding unit.
Figure 3:
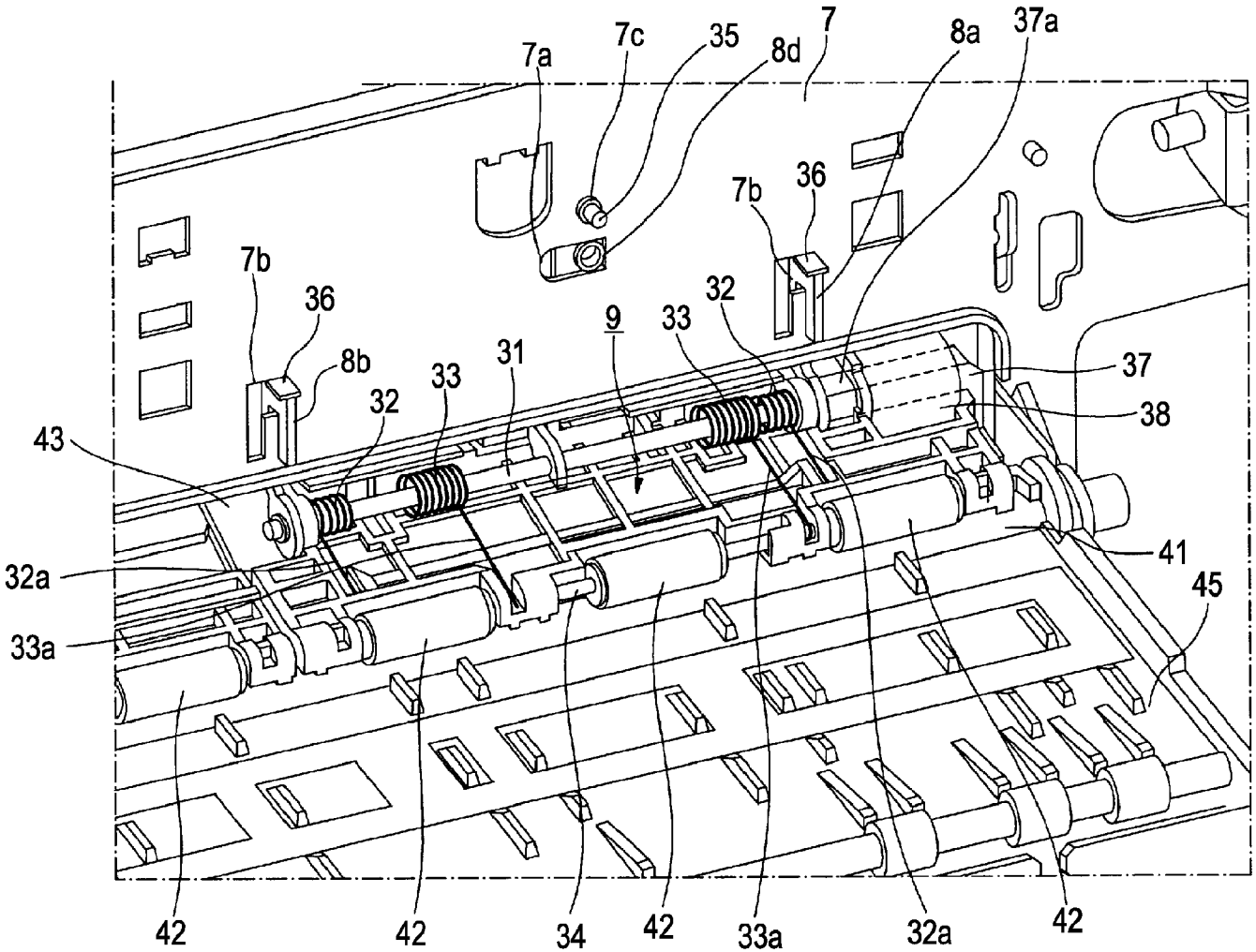
FIG. 3 is a perspective view of the upper sheet-guiding unit in its installed state.
Figure 4:
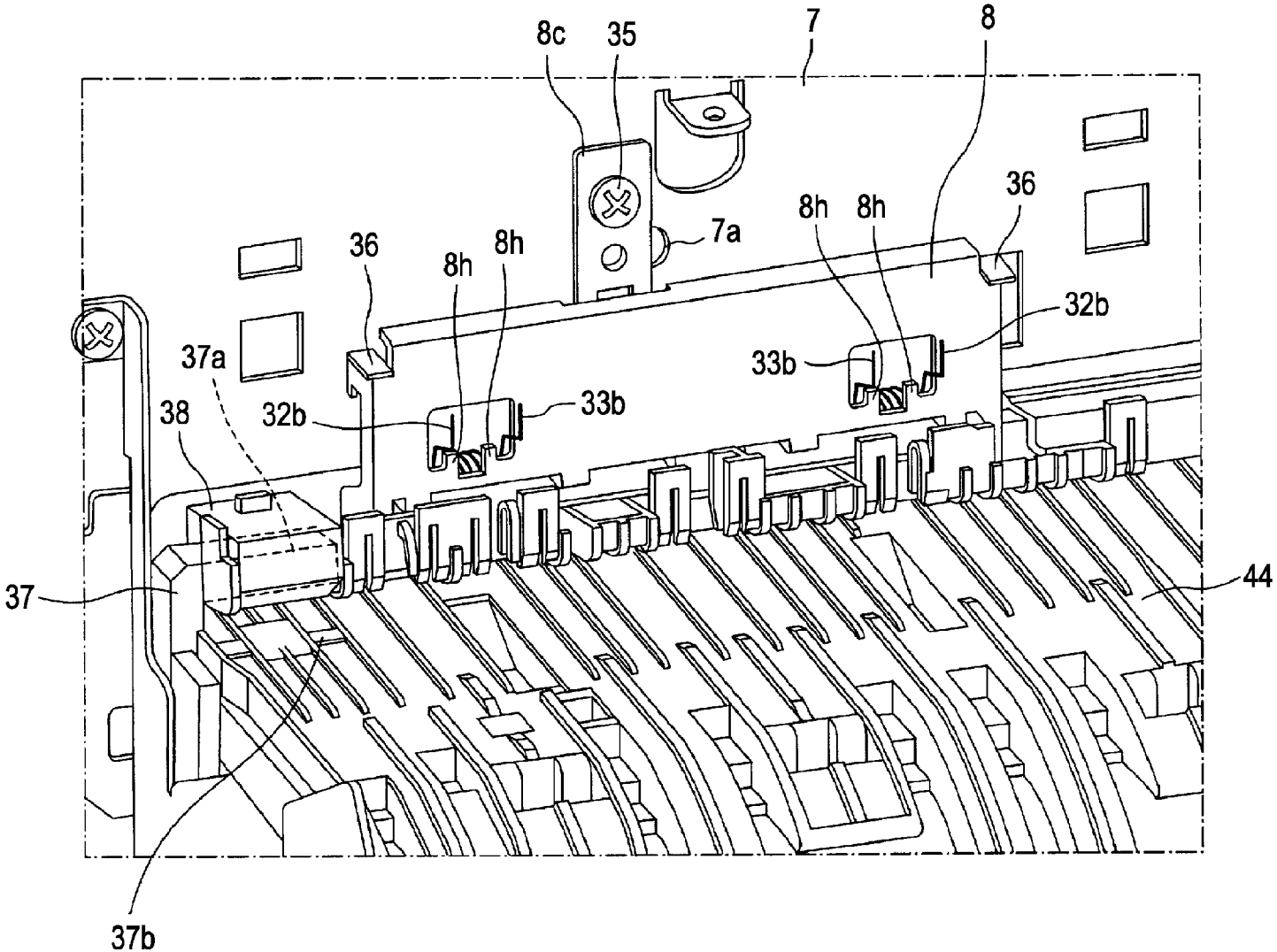
FIG. 4 is a perspective view of the upper sheet-guiding unit in its installed state.
Figure 5:
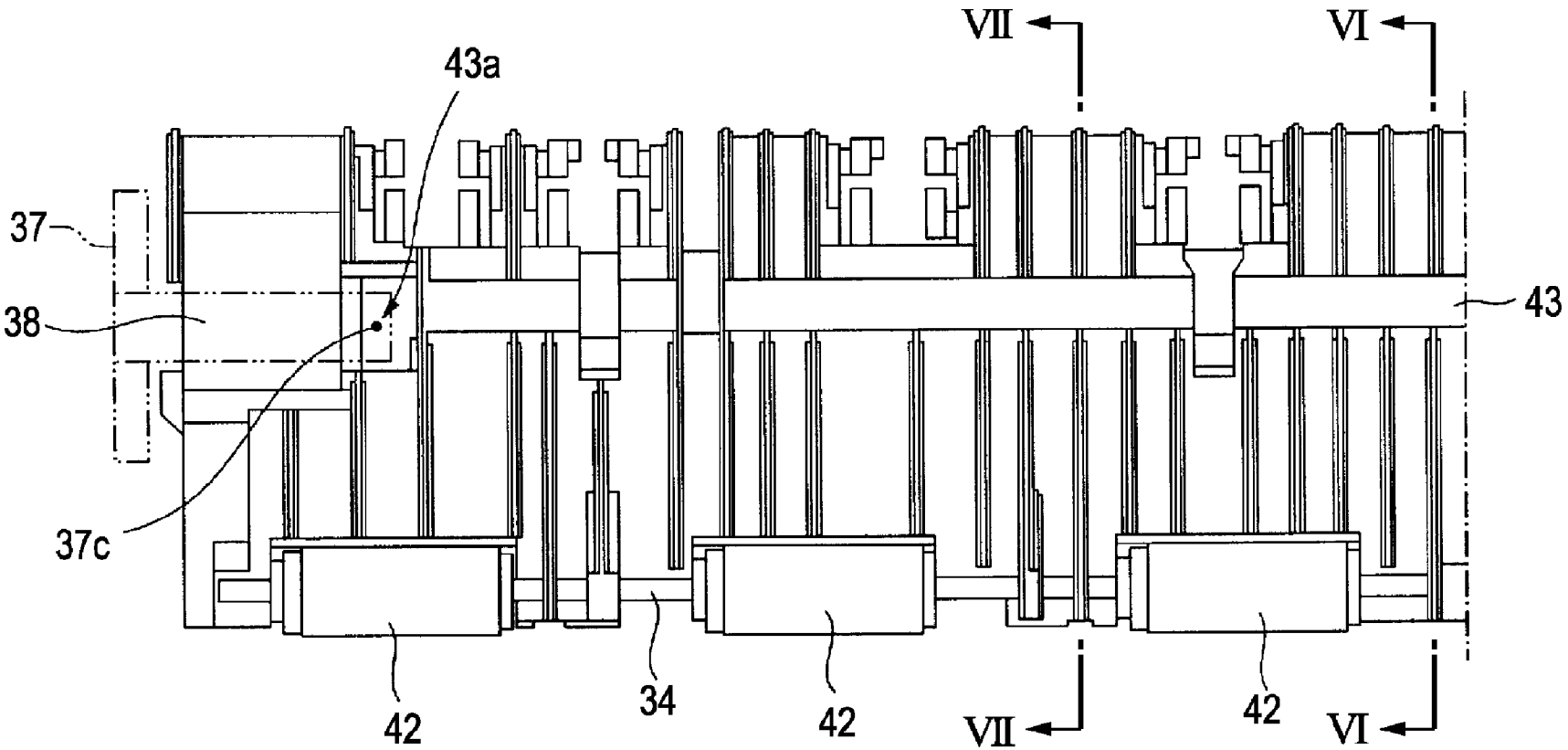
FIG. 5 is a plan view of the upper sheet-guiding unit, as viewed from below.
Figure 6:
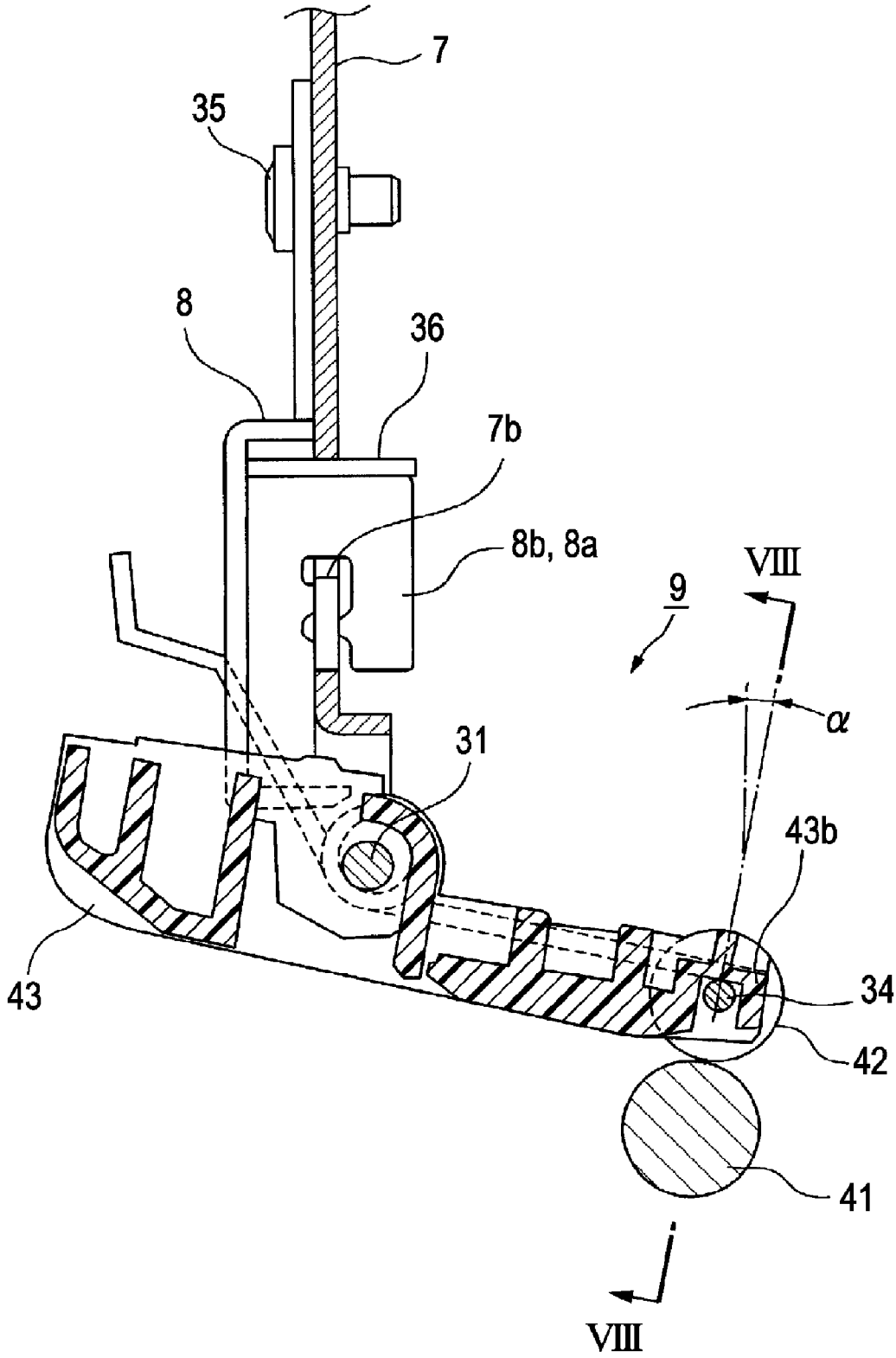
FIG. 6 is a cross-sectional view taken along line VI-VI in FIG. 5.
Figure 7:
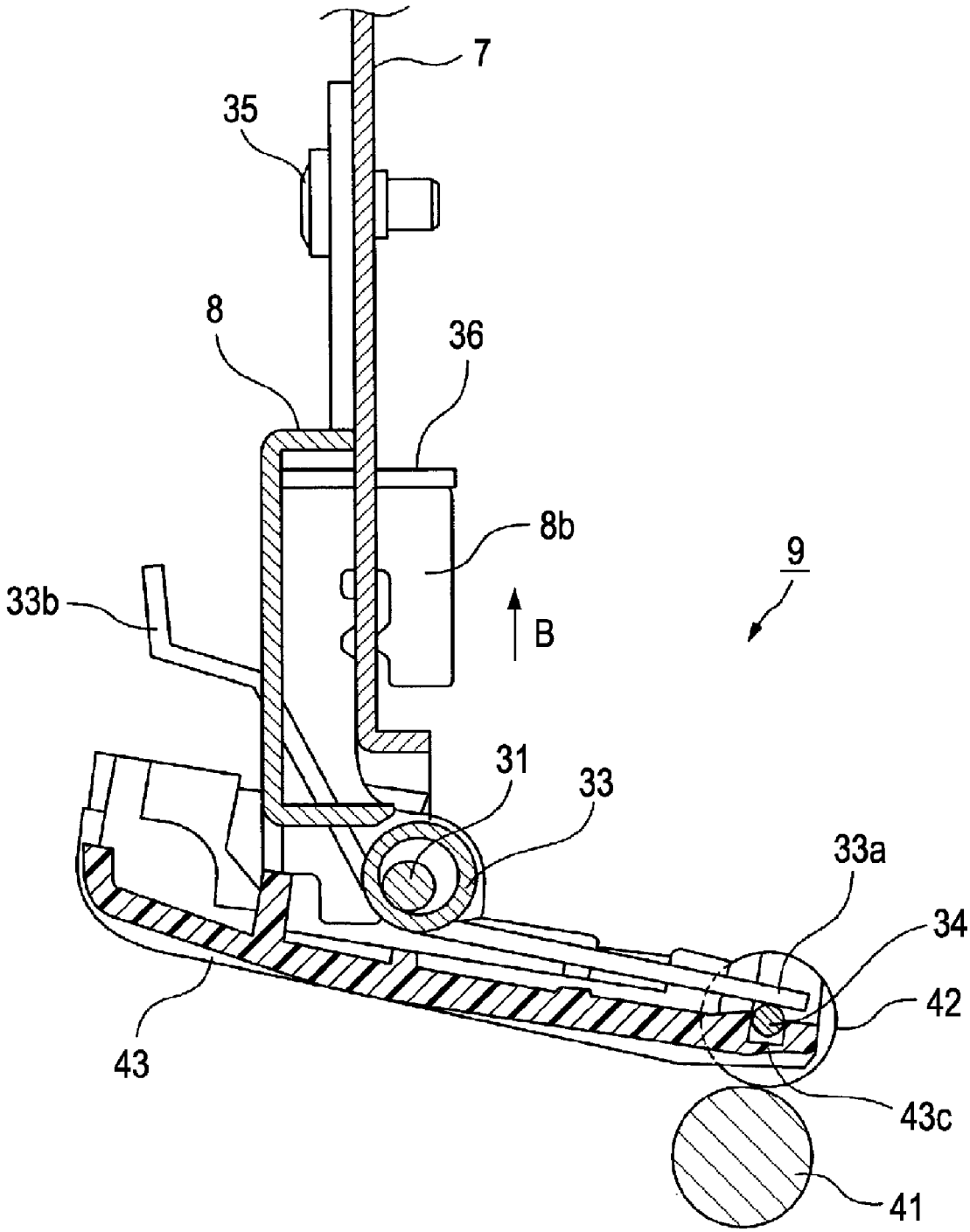
FIG. 7 is a cross-sectional view taken along line VII-VII in FIG. 5.
Figure 8:
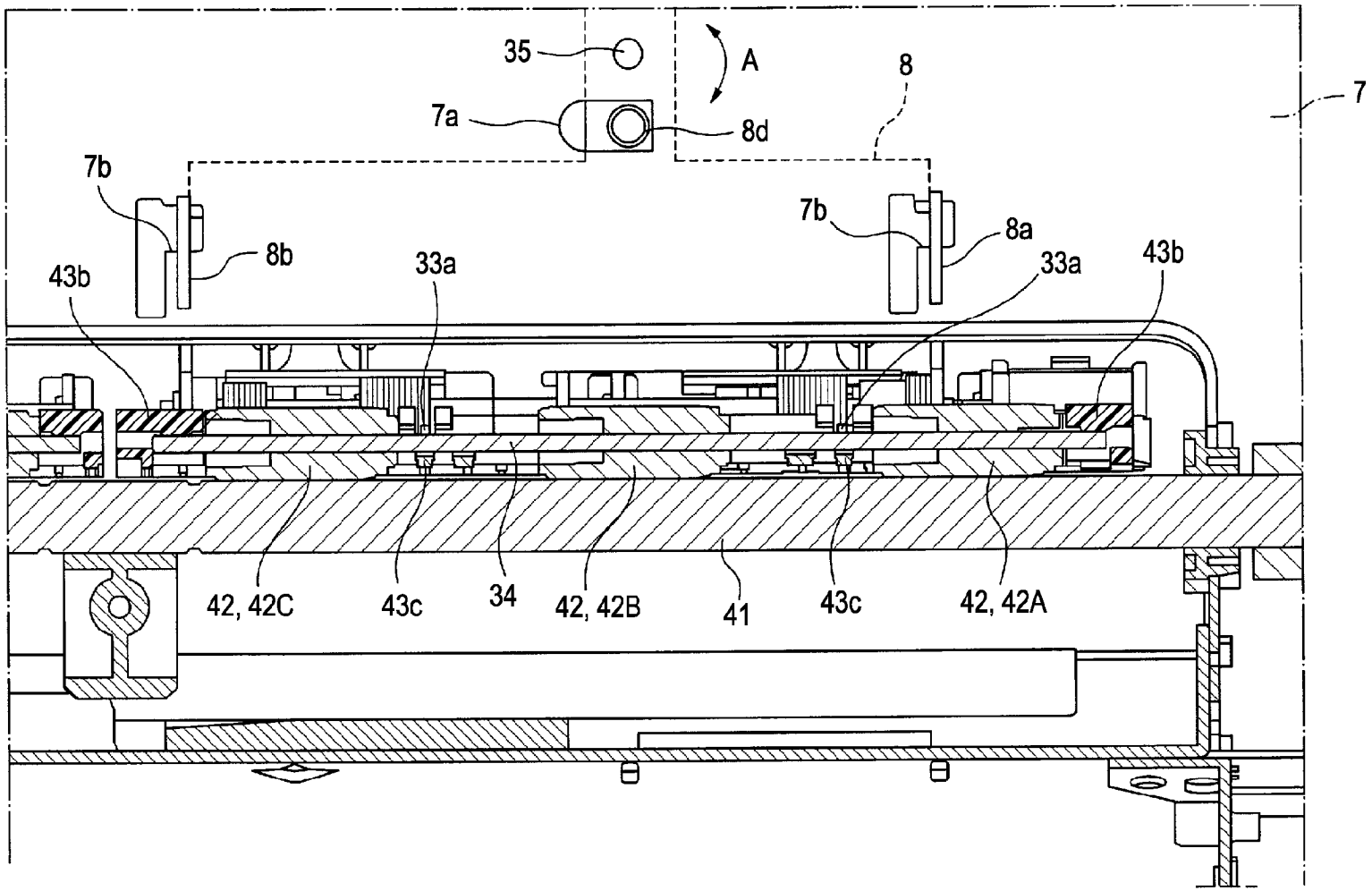
FIG. 8 is a cross-sectional view taken along line VIII-VIII in FIG. 6.
Figure 9:
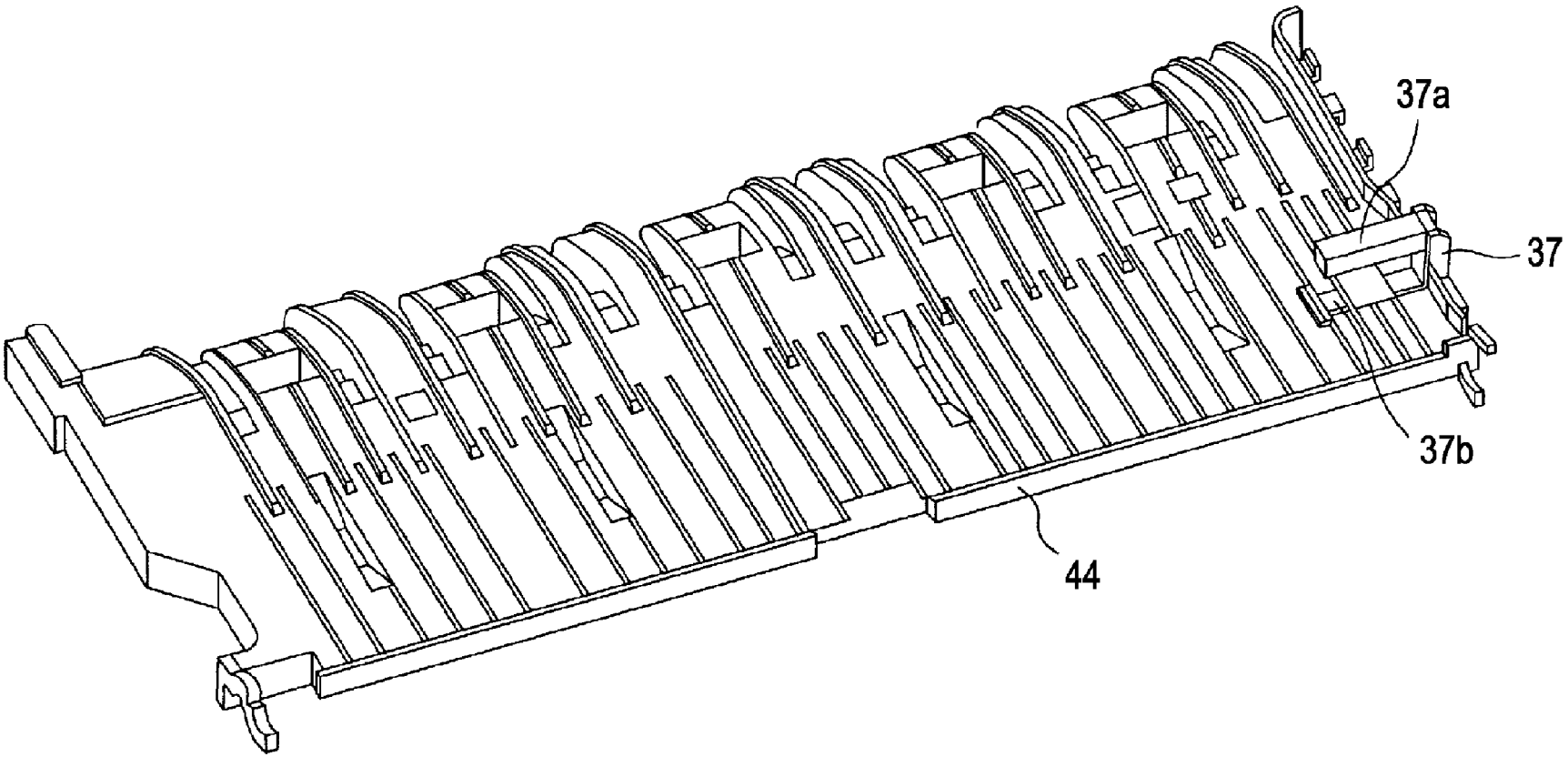
FIG. 9 is a perspective view of a rear sheet guide.
Figure 10:
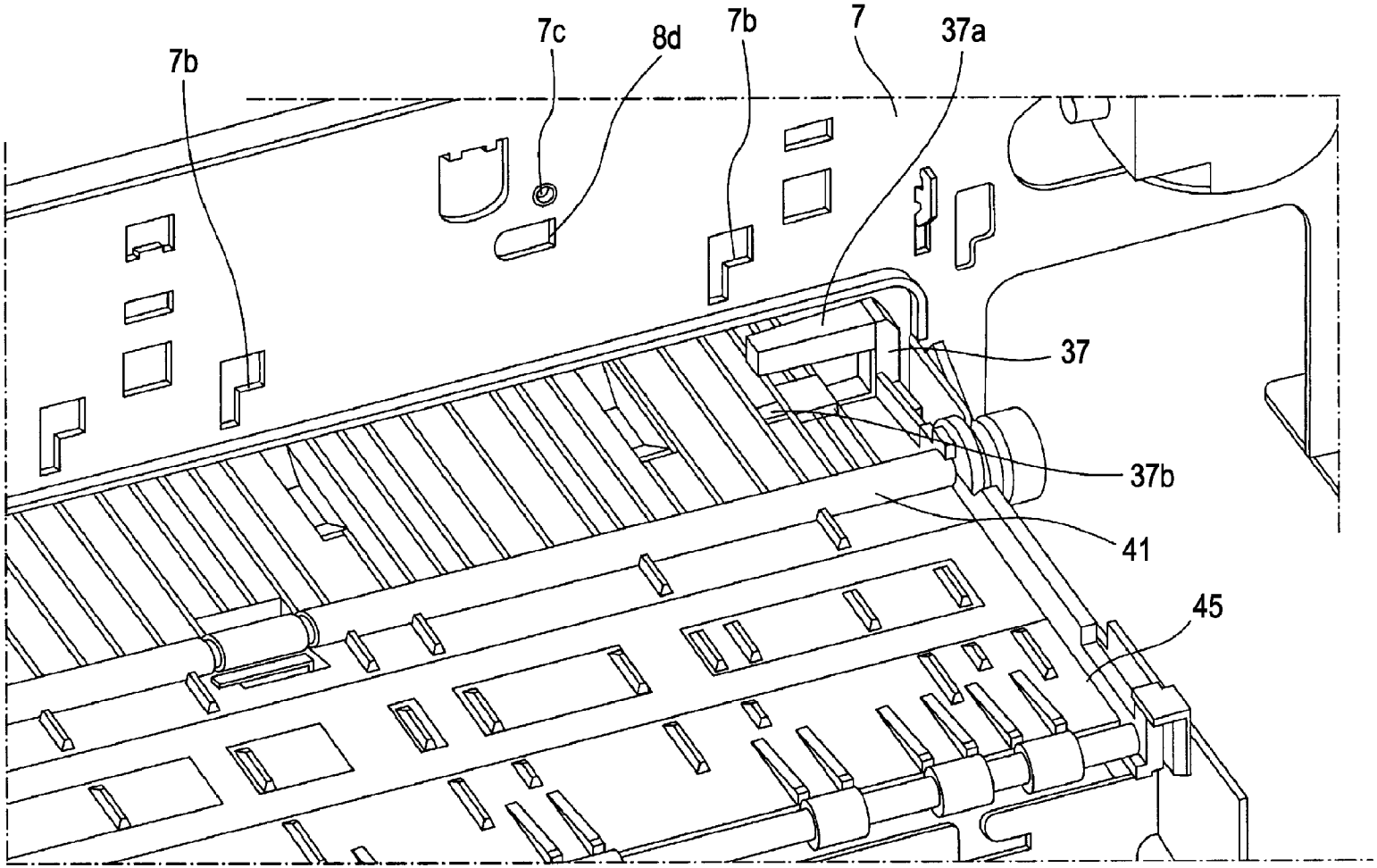
FIG. 10 is a perspective view of the rear sheet guide in its installed state.
Figure 11A:
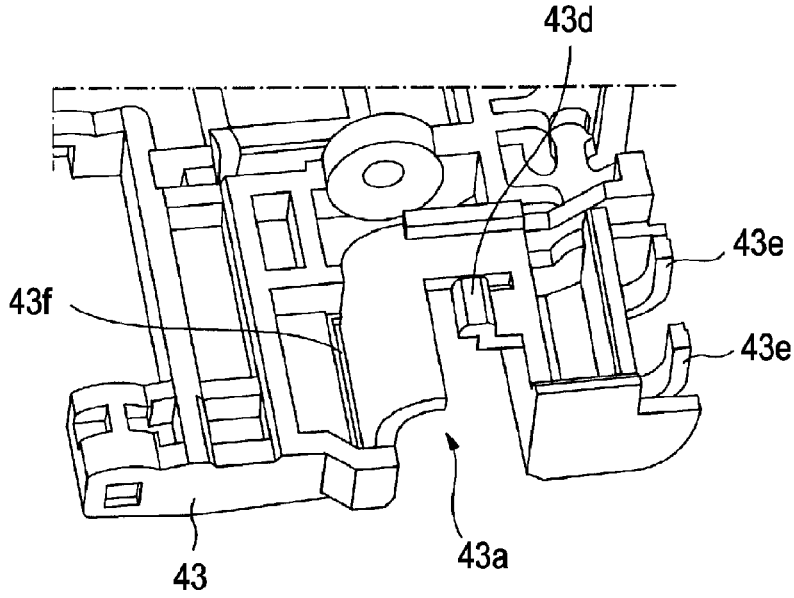
FIGS. 11A to 11C illustrate a mounting method of a sheet member.
Figure 11B:
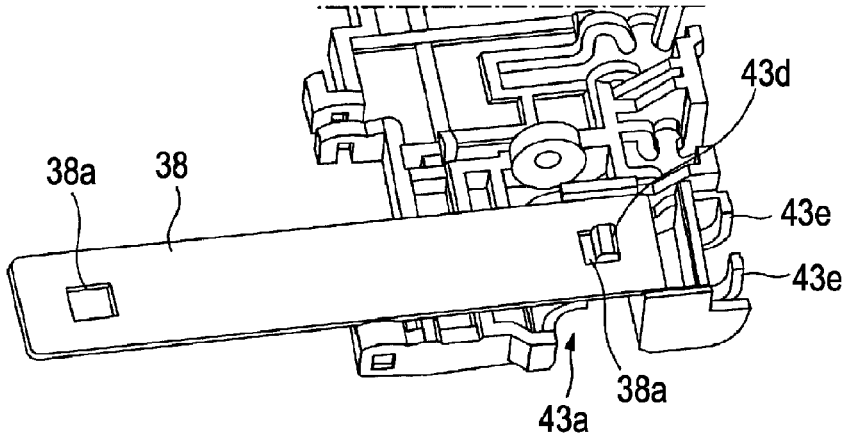
Figure 11C:
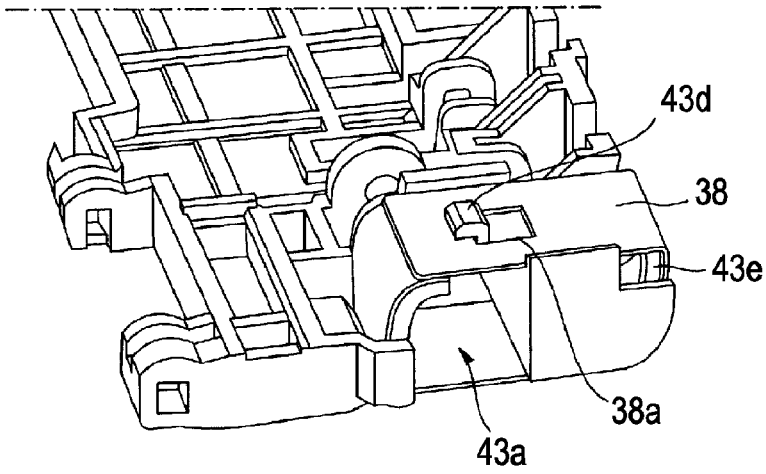

An embodiment of the invention will now be described with reference to FIGS. 1 to 11C. FIG. 1 is a schematic cross-sectional view of an ink jet printer 1 according to an embodiment of the invention. The ink jet printer 1 corresponds to a recording apparatus or a liquid ejecting apparatus according to the invention, and will simply be referred to as a printer 1 hereinafter. FIG. 2 is a perspective view of an upper sheet-guiding unit 9. FIGS. 3 and 4 are perspective views of the upper sheet-guiding unit 9 in its installed state. Specifically, FIG. 3 is viewed from the front of the printer 1, whereas FIG. 4 is viewed from the back of the printer 1. FIG. 5 is a plan view of the upper sheet-guiding unit 9, as viewed from below. FIG. 6 is a cross-sectional view taken along line VI-VI in FIG. 5. FIG. 7 is a cross-sectional view taken along line VII-VII in FIG. 5. FIG. 8 is a cross-sectional view taken along line VIII-VIII in FIG. 6. FIG. 9 is a perspective view of a rear sheet guide 44. FIG. 10 is a perspective view of the rear sheet guide 44 in its installed state. FIGS. 11A to 11C are perspective views of an upper sheet guide 43 and illustrate a mounting method of a sheet member 38.

The overall configuration of the printer 1 will be described below with reference to FIG. 1. The printer 1 includes a rear feeder device 2 and a front feeder device 3 disposed respectively at the rear and the bottom of the printer 1. The two feeder devices feed a recording sheet serving as a recording medium or a liquid-receiving medium towards a transporting unit 5. The transporting unit 5 transports the recording sheet to a recording unit 4 (recording head 48) where recording is performed on the recording sheet. Subsequently, a discharging unit 6 discharges the recording sheet onto a stacker (not shown).

Components arranged along a sheet transport path will be described below in detail.

The rear feeder device 2 includes a hopper 12, a feed roller 11, a retard roller 13, a return lever 14, and other components that are not shown.

The hopper 12 has a plate-like body and is tiltable about a fulcrum 12*a* located at an upper portion thereof. The hopper 12 can be tilted switchably between a position where sheets P supported obliquely on the hopper 12 are made in pressure-contact with the feed roller 11 and a position where the sheets P are set apart from the feed roller 11.

The feed roller 11 has a cylindrical shape and rotates to feed an uppermost sheet P downstream. The retard roller 13 has its outer periphery made of an elastic material and can move into pressure-contact with the feed roller 11. In addition, the retard roller 13 is disposed in a state where a predetermined rotational resistance is imparted thereon by a torque-limiter mechanism. The retard roller 13 and the feed roller 11 nip one sheet P at a time to prevent multiple sheets from being fed at the same time. If such multi-feeding of sheets occurs, the return lever 14 returns the leading end of subsequent sheet or sheets caught between the feed roller 11 and the retard roller 13 onto the hopper 12.

On the other hand, the front feeder device 3 disposed at the bottom of the printer 1 and configured to feed sheets from the front of the printer 1 includes a feeder cassette 25, a pick-up roller 26, a feed roller 28, a separating roller 29, and an assist roller 30.

When the pick-up roller 26 is rotationally driven by a motor (not shown), the pick-up roller 26 rotates in contact with an uppermost sheet P set in the feeder cassette 25 which is both attachable and detachable from the front-side of the printer 1. This rotation of the pick-up roller 26 causes the uppermost sheet P to be fed from the feeder cassette 25. The feed roller 28 rotated by a motor (not shown) bends and flips the uppermost sheet P fed from the feeder cassette 25 and transports the sheet to a transport driving roller 41 via the rear sheet guide 44.

The separating roller 29 is disposed at a position facing an outer periphery surface of the feed roller 28 and can be shifted towards and away from the feed roller 28. When an uppermost sheet P is to be fed from the feeder cassette 25, the separating roller 29 moves into pressure-contact with the feed roller 28 so as to form a nip therebetween. Thus, if one or more sheets are fed from the feeder cassette 25 together with the uppermost sheet P, the leading end of the subsequent sheet or sheets P can be retained at the nip. The assist roller 30 is disposed in contact with the outer periphery surface of the feed roller 28, such that the assist roller 30 and the feed roller 28 can nip one sheet P at a time. The assist roller 30 thus assists with the feeding of a sheet P as the feed roller 28 rotates.

At the downstream side of the rear feeder device 2 and the front feeder device 3 are disposed the rear sheet guide 44 that guides a fed sheet P to the transporting unit 5, the upper sheet-guiding unit 9, and an optical sensor 37 (see FIG. 3) that detects passing of a sheet P. A sheet P fed by the rear feeder device 2 or the front feeder device 3 travels along a transport path formed between the upper sheet guide 43 serving as a first guide member and the rear sheet guide 44 serving as a second guide member so as to reach the transporting unit 5. Reference numeral 40 denotes a guide roller that determines the orientation of a sheet P fed from the rear feeder device 2. The guide roller 40 is supported by the upper sheet guide 43 in a freely rotatable fashion. The guide roller 40 is not shown in FIG. 2 onward.

The transporting unit 5 includes the transport driving roller 41 rotated by a motor, and a plurality of transport driven rollers 42 rotatably supported by the upper sheet guide 43 and rotated by being in pressure-contact with the transport driving roller 41. The transport driving roller 41 has an adhesive layer that is formed by dispersing abrasion-resistant particles substantially uniformly over an outer periphery surface of a metal shaft extending in the sheet-width direction. On the other hand, the outer periphery surface of each transport driven roller 42 is composed of a low-friction material such as polyacetal resin. The plurality of transport driven rollers 42 is arranged in the axial direction of the transport driving roller 41 (which will be described in detail below).

When a sheet P reaches the transporting unit 5, the transport driving roller 41 rotates while the sheet P is nipped between the transport driving roller 41 and the transport driven rollers 42, thereby transporting the sheet P downstream towards the recording unit 4 (i.e. the recording head 48).

The recording head 48 is provided at the bottom of a carriage 46. The carriage 46 is driven by a drive motor (not shown) in a reciprocating fashion in a main scanning direction (i.e. direction perpendicular to the plane of drawing of FIG. 1) while being guided by a carriage guide shaft 47 extending in the main scanning direction. The carriage 46 holds a plurality of ink cartridges (not shown) provided individually for multiple colors. Each ink cartridge supplies the recording head 48 with ink. The carriage guide shaft 47 is supported by a main frame 7 that has a substantially C-shape in plan view.

At a position facing the recording head 48 is provided a front sheet guide 45 that supports a sheet P from below. The front sheet guide 45 defines the space between the sheet P and the recording head 48. At a downstream side of the recording unit 4 are provided an auxiliary roller 57 that prevents the sheet P from rising from the front sheet guide 45, and the discharging unit 6 that discharges the sheet P undergone recording. The discharging unit 6 includes a discharge driving roller 55 rotated by a motor (not shown) and a discharge driven roller 56 rotated by being in contact with the discharge driving roller 55. After the sheet P undergoes recording at the recording unit 4, the discharge driving roller 55 is rotated while the sheet P is nipped between the discharge driving roller 55 and the discharge driven roller 56, whereby the sheet P is discharged to a stacker (not shown) provided at the front of the printer 1.

The above description is the general outline of the printer 1. The upper sheet-guiding unit 9 will now be described below in detail with reference to FIGS. 2 to 11C.

In this embodiment, the transport driven rollers 42 are supported by two unit bodies arranged in the main scanning direction (i.e. the sheet-width direction). Referring to FIG. 3, the upper sheet-guiding unit 9 according to the embodiment of the invention is a unit body provided at a side near a sheet-transport reference position (i.e. the first-column side or the right side in FIG. 3). Because the upper sheet-guiding unit 9 shown in FIGS. 2 to 11C is provided at the side near the sheet-transport reference position, sheets of all transportable sizes will pass through between the upper sheet-guiding unit 9 and the rear sheet guide 44.

Referring to FIG. 2, the upper sheet-guiding unit 9 includes a sub frame 8, the upper sheet guide 43, a shaft 31, two coil springs 32, two coil springs 33, a shaft body 34, three transport driven rollers 42, and the sheet member 38. These components are assembled together to constitute the upper sheet-guiding unit 9 serving as a unit body.

The sub frame 8 is formed by bending a metal plate into a substantially C-shape in plan view defined by frame engagement segments 8*a* and 8*b*, and also has a tongue segment 8*c*. The frame engagement segments 8*a* and 8*b* respectively have shaft bearings 8*f* and 8*g*. The shaft bearings 8*f* and 8*g* rotatably support the shaft 31. The upper sheet guide 43 is pivotably supported by the sub frame 8 about the shaft 31, and the sub frame 8 (the upper sheet-guiding unit 9) is attached to the main frame 7. Consequently, in side view, the upper sheet guide 43 is provided in a rockable fashion above the sheet transport path.

The upper sheet guide 43 is composed of a resin material and has certain flexibility. As mentioned above, the upper sheet guide 43 is pivotably supported by the sub frame 8, and rotatably supports the shaft body 34 for the transport driven rollers 42 at an end portion of the upper sheet guide 43. The shaft 31 extends through coil portions of the two coil springs 32 and coil portions of the two coil springs 33. The two coil springs 32 exhibit a bias force between the sub frame 8 and the upper sheet guide 43, and likewise, the two coil springs 33 exhibit a bias force between the sub frame 8 and the shaft body 34.

More specifically, the coil springs 32 have first ends 32*a* that extend from the coil portions toward the transport driven rollers 42, and second ends 32*b* that are hooked to corresponding hook portions 8*h* provided in the sub frame 8 (see also FIG. 4). Thus, the first ends 32*a* bias the upper sheet guide 43 from above. On the other hand, the coil springs 33 have first ends 33*a* that extend from the coil portions toward the shaft body 34, and second ends 33*b* that are hooked to corresponding hook portions 8*h* provided in the sub frame 8. Thus, the first ends 33*a* directly bias the shaft body 34.

As shown in FIGS. 6 and 8, the upper sheet guide 43 has shaft bearings 43*b* that restrict upward movement of the shaft body 34 at opposite shaft ends thereof. Moreover, as shown in FIGS. 7 and 8, the upper sheet guide 43 also has shaft bearings 43*c* that restrict downward movement of the shaft body 34 at an intermediate section thereof. Although the vertical movement is restricted in this manner, slight movement in the vertical direction is permitted. The opposite shaft ends of the shaft body 34 receive the bias force of the coil springs 32 via the shaft bearings 43*b*, and the intermediate section of the shaft body 34 directly receives the bias force of the coil springs 33.

Although the shaft body 34 serves as a rotary shaft for the transport driven rollers 42, when the shaft body 34 is fitted to the upper sheet-guiding unit 9, the shaft body 34 becomes a stationary shaft that does not rotate relative to the upper sheet guide 43. In contrast, the transport driven rollers 42 rotate relatively with respect to the shaft body 34. In detail, the first ends 33*a* of the coil springs 33 directly bias the shaft body 34, and the inner periphery surfaces of the transport driven rollers 42 are composed of a low-friction material or have a lubricant applied thereto. This allows a total value of a frictional force between the shaft body 34 and the shaft bearings 43*b* of the upper sheet guide 43 and a frictional force between the shaft body 34 and the first ends 33*a* of the coil springs 33 to be greater than a total value of a frictional force between the shaft body 34 and the plurality of transport driven rollers 42.

Consequently, this prevents the occurrence of abnormal noise caused by the upper sheet guide 43 and the shaft body 34 sliding against each other when the transport driven rollers 42 rotate. In addition, although the shaft body 34 rotating relative to the upper sheet guide 43 can cause the sheet transport accuracy to lower as a result of bending or decentering of the shaft body 34, such defect is prevented from occurring since the shaft body 34 is stationary with respect to the upper sheet guide 43.

An angle $\alpha$ shown in FIG. 6 indicates an angle formed between a line that connects the center of axle of the transport driving roller 41 and the center of axle of the transport driven rollers 42 and a vertical line (i.e. a line extending parallel to the direction of gravitational force) in a side view of the sheet transport path. If the angle $\alpha$ varies among the plurality of transport driven rollers 42, or in other words, if the contact points of the transport driven rollers 42 with respect to the transport driving roller 41 vary from one another, a transport force to be applied to a sheet by the transport driving roller 41 and the transport driven rollers 42 may vary among the transport driven rollers 42. This can cause the sheet to become skewed.

In order to solve this problem, the following configuration is applied in this embodiment. The upper sheet guide 43 is given a width dimension that is greater than or equal to a width dimension of a sheet of a certain size. In this embodiment, the upper sheet guide 43 is given a width dimension that can cover a sheet having a 4-inch width. This implies that when a sheet having a width dimension that is 4 inches or less is used, the sheet is pressed by only the transport driven rollers 42 that are supported by one upper sheet guide 43. In other words, a plurality of upper sheet guides 43 are not involved. Accordingly, this configuration can reduce variations in contact points between the transport driven rollers 42 (three rollers 42 in this embodiment) supported by one upper sheet guide 43 and the transport driving roller 41.

As shown in FIGS. 5 and 8, the three transport driven rollers 42 are arranged at substantially equal intervals in the sheet-width direction. Furthermore, bias force is imparted not only to the opposite shaft ends of the shaft body 34 but also to the intermediate section of the shaft body 34 so that the opposite ends of each transport driven roller 42 will always receive the bias force. Moreover, the bias force of the coil springs 32 and 33 is set such that a sheet receives substantially uniform load when the sheet comes into contact with the transport driven rollers 42. Accordingly, the transport driven rollers 42 apply uniform pressing force to a sheet, thereby preventing the occurrence of skew caused by variations in pressure load. Furthermore, since the load applied to a sheet when the transport driven rollers 42 are in contact with the sheet is prevented from being concentrated in one area, the sheet is prevented from being damaged.

In addition, the orientation of the upper sheet-guiding unit 9 (the sub frame 8) mounted on the main frame 7 is adjustable. Therefore, even when the contact points between the transport driven rollers 42 and the transport driving roller 41 vary from one another, or in other words, the angle $\alpha$ in FIG. 6 varies among the three transport driven rollers 42, such variations can be corrected. A structure of the upper sheet-guiding unit 9 (the sub frame 8) that allows the orientation thereof to be adjustable will be described below in detail.

Referring to FIG. 2, the tongue segment 8*c* of the sub frame 8 has an oblong hole 8*e* and a boss 8*d*. Referring to FIG. 3, the main frame 7 has a hole 7*c* through which a fixing screw 35 for fixing the sub frame 8 to the main frame 7 extends, and also has a hole 7*a* to which the boss 8*d* on the tongue segment 8*c* of the sub frame 8 is loosely fitted. When the fixing screw 35 is loosened from a state where the sub frame 8 is attached to the main frame 7, the sub frame 8 becomes tiltable about the boss 8*d* (in directions indicated by an arrow A in FIG. 8), whereby the orientation of the upper sheet-guiding unit 9 becomes adjustable. Specifically, with reference to the middle one of the three transport driven rollers 42, the contact points of the two remaining opposite transport driven rollers 42 with respect to the transport driving roller 41 (i.e. the angle $\alpha$ in FIG. 6) become adjustable.

On the other hand, the frame engagement segments 8*a* and 8*b* of the sub frame 8 have the shape of hooks. The frame engagement segments 8*a* and 8*b* are respectively hooked to lock portions 7*b* and 7*b* in the main frame 7. In this case, when the upper sheet-guiding unit 9 is attached to the main frame 7, the bias force of the coil springs 32 and 33 (acting in a direction indicated by an arrow B in FIG. 7) causes the frame engagement segments 8*a* and 8*b* to be in pressure-contact with the upper edges of the lock portions 7*b* and 7*b*. By utilizing this property, the orientation of the upper sheet-guiding unit 9 is adjusted by disposing spacers 36 between the frame engagement segments 8*a* and 8*b* and the upper edges of the lock portions 7*b* and 7*b*.

For example, in order to tilt the orientation of the upper sheet-guiding unit 9 clockwise in FIG. 8, a spacer 36 is interposed between the frame engagement segment 8*a* on the right side and the upper edge of the corresponding lock portion 7*b*. This causes the fulcrum of the upper sheet guide 43 at the right side thereof (i.e. the side of the frame engagement segment 8*a*) to be shifted downward, whereby the contact point between the transport driven roller 42 on the right side (indicated with reference numeral 42A in FIG. 8) and the transport driving roller 41 becomes shifted downstream in the sheet transporting direction (i.e. towards the right in FIG. 6). In other words, the angle $\alpha$ in FIG. 6 is increased.

On the other hand, tilting the orientation of the upper sheet-guiding unit 9 counterclockwise in FIG. 8 simply involves a process opposite to that described above. Therefore, the process will not be described here. In the state where the frame engagement segments 8*a* and 8*b* are respectively hooked to the lock portions 7*b* and 7*b*, the frame engagement segments 8*a* and 8*b* are preferably permitted to move vertically to an extent that the spacers 36 can be interposed between the frame engagement segments 8*a* and 8*b* and the upper edges of the respective lock portions 7*b* and 7*b*. Furthermore, when the orientation of the upper sheet-guiding unit 9 is adjusted, one of the shaft bearings 43*b* and 43*b* that bias the opposite ends of the shaft body 34 for the transport driven rollers 42 becomes shifted upward. For this reason, the upper sheet guide 43 is preferably made of a flexible material. Thus, even when the orientation of the upper sheet-guiding unit 9 is adjusted, the shaft bearings 43*b* and 43*b* can properly bias the opposite ends of the shaft body 34.

Accordingly, the orientation of the upper sheet-guiding unit 9 (the sub frame 8) relative to the main frame 7 is adjustable in the above-described manner. Therefore, even when the contact points of the three transport driven rollers 42 (i.e. transport driven rollers 42A, 42B, 42C in FIG. 8) with respect to the transport driving roller 41 vary from one another due to low fabrication precision of the components or low assembly precision of the apparatus, such variations can be corrected. Accordingly, this prevents a sheet from being skewed when being transported.

Referring to FIGS. 9 to 11C, a mount structure of the optical sensor 37 will be described below. The optical sensor 37 integrally has a light-emitting portion 37*a* and light-receiving portion 37*b* and is substantially C-shaped. The optical sensor 37 is disposed such that an optical axis thereof traverses the sheet transport path formed between the upper sheet guide 43 and the rear sheet guide 44. Thus, the optical sensor 37 can detect passing of the leading end or trailing end of a sheet.

FIG. 10 illustrates a base body of the printer in a state where the main frame 7 does not yet have the upper sheet-guiding unit 9 attached thereto. As shown in FIG. 10, the optical sensor 37 is provided near the sheet-transport reference position (i.e. the first-column side or the right side in FIG. 10) and projects inward from an outer edge of the sheet transport path. As shown in FIG. 9, the optical sensor 37 is fixed to the rear sheet guide 44. Specifically, after preliminarily mounting the optical sensor 37 onto the rear sheet guide 44, the rear sheet guide 44 is attached to the main frame 7 so that the installed state shown in FIG. 10 is attained. The rear sheet guide 44 has preliminarily formed therein a window hole through which the light-receiving portion 37*b* can be exposed.

In the installed state shown in FIG. 10, the light-emitting portion 37*a* is positioned where it will come into contact with the upper sheet guide 43. Therefore, as shown in FIGS. 11A to 11C, the upper sheet guide 43 is provided with a cutout 43*a* for accommodating the light-emitting portion 37*a*. The cutout 43*a* has an opening at a side near the sheet-transport reference position and an opening at a side facing the rear sheet guide 44. The opening of the cutout 43*a* facing the rear sheet guide 44 is covered with the sheet member 38 except for an area where the optical axis of the optical sensor 37 extends, as shown in FIG. 5. Reference numeral 37*c* in FIG. 5 denotes the optical axis of the optical sensor 37.

The sheet member 38 is in the form of a rectangular strip with window holes 38*a* and 38*a* at its opposite ends. The sheet member 38 is made of a flexible material. On the other hand, the upper sheet guide 43 has a hook 43*d*. Referring to FIG. 11B, one of the window holes 38*a* of the sheet member 38 is hooked onto the hook 43*d*. Subsequently, referring to FIG. 11C, the sheet member 38 is wound through a through hole 43*f*, and the other window hole 38*a* is then hooked onto the hook 43*d*, whereby the sheet member 38 is mounted onto the upper sheet guide 43. Reference numeral 43*e* denotes a tension applying part that biases the sheet member 38 wound around the upper sheet guide 43 from inward to outward so as to prevent the sheet member 38 from being excessively loose.

As described above, the light-emitting portion 37*a* of the optical sensor 37 is disposed facing a side surface of the upper sheet guide 43 at the side near the sheet-transport reference position and projects inward from an outer edge of the sheet transport path, that is, towards the upper sheet guide 43. Moreover, the upper sheet guide 43 has the cutout 43*a* for accommodating the light-emitting portion 37*a*. Consequently, when the upper sheet-guiding unit 9 is to be attached to the base body of the printer 1 as shown in FIG. 10, the upper sheet-guiding unit 9 is first slid from left to right in FIG. 10 and is then attached to the base body so that the cutout 43*a* accommodates therein the light-emitting portion 37*a*.

Accordingly, instead of the optical sensor 37 being mounted directly on the base body of the printer 1, the rear sheet guide 44 with the optical sensor 37 preliminarily mounted thereto is attached to the main frame 7 so that the optical sensor 37 can be installed in the base body of the printer 1. This enhances the workability in the mounting process of the optical sensor 37 as well as facilitating the adjustment process of the mount position.

In place of the cutout 43*a* as in this embodiment, if a simple window hole for exposing the light-emitting portion 37*a* is to be formed in the upper sheet guide 43, the mounting process of the optical sensor 37 will need to performed after the upper sheet-guiding unit 9 is attached to the main frame 7. This can unfavorably lead to lower workability in the mounting process of the optical sensor 37 and lower workability in the positional adjustment process. At the same time, the light-emitting portion 37*a* and the light-receiving portion 37*b* of the optical sensor 37 may need to be provided as separate components. In that case, for example, the fixation position of the light-emitting portion 37*a* will be distant in a direction perpendicular to the sheet transport path (i.e. in the upward direction, such as any position on the main frame 7). This can lead to reduced accuracy in the mount position of the optical sensor 37. In contrast, the cutout 43*a* provided in this embodiment eliminates such problems.

Since the opening of the cutout 43*a* facing the rear sheet guide 44 is covered with the sheet member 38, the leading end of a sheet passing through between the upper sheet guide 43 and the rear sheet guide 44 is prevented from getting stuck at the opening of the cutout 43*a*. Consequently, this prevents bending of the leading end of a sheet and also prevents a sheet from being skewed as a result of the leading end thereof being stuck at the opening. Since the sheet member 38 has the above-described function, the surface of the sheet member 38 preferably has a low coefficient of friction with respect to a sheet.

What is claimed is:

1. A recording apparatus comprising:

a recording unit that performs recording on a recording medium;

a transporting unit that is disposed upstream of the recording unit and transports the recording medium downstream;

a first guide member and a second guide member disposed facing the first guide member, the first and second guide members having an upstream section of a transport path of the recording medium disposed therebetween; and an optical sensor including a light-emitting portion and a light-receiving portion, the optical sensor having an optical axis that traverses the transport path of the recording medium between the first and second guide members, wherein at least one of the light-emitting portion and the light-receiving portion projects from an outer side of the transport path towards the first guide member, and wherein the first guide member has a cutout having an opening that faces the second guide member, the cutout having the light-emitting portion or the light-receiving portion disposed therein, the opening of the cutout being covered with a sheet member except for an area where the optical axis of the optical sensor extends.

2. The recording apparatus according to claim 1, wherein the sheet member has flexibility and is provided in the first guide member such that the sheet member is wound around the first guide member to cover the opening facing the second guide member.

3. The recording apparatus according to claim 1, wherein the light-emitting portion and the light-receiving portion are integrated with each other, and wherein the optical sensor is mounted on the second guide member.

4. The recording apparatus according to claim 1, wherein the transporting unit includes a rotatably-driven transport driving roller and a transport driven roller rotated by being in contact with the transport driving roller, and wherein the first guide member rotatably supports the transport driven roller and is pivotably attached to a main frame constituting a base body of the recording apparatus.

5. A liquid ejecting apparatus comprising:

a liquid ejecting unit that ejects liquid onto a liquid-receiving medium;

a transporting unit that is disposed upstream of the liquid ejecting unit and transports the liquid-receiving medium downstream;

a first guide member and a second guide member disposed facing the first guide member, the first and second guide members having an upstream section of a transport path of the liquid-receiving medium disposed therebetween; and an optical sensor including a light-emitting portion and a light-receiving portion, the optical sensor having an optical axis that traverses the transport path of the liquid-receiving medium between the first and second guide members, wherein at least one of the light-emitting portion and the light-receiving portion projects from an outer side of the transport path towards the first guide member, and wherein the first guide member has a cutout having an opening that faces the second guide member, the cutout having the light-emitting portion or the light-receiving portion disposed therein, the opening of the cutout being covered with a sheet member except for an area where the optical axis of the optical sensor extends.

* * * * *